United States Patent [19]

Varis et al.

[11] 4,057,076

[45] Nov. 8, 1977

[54] WASTE WATER VALVE

[76] Inventors: Martti Varis, Kalkkipellonmaki A 3, 02600 Leppavaara; Krister Nordberg, Hietalahdenkatu 7 A, 00180 Helsinki 18, both of Finland

[21] Appl. No.: 686,799

[22] Filed: May 13, 1976

Related U.S. Application Data

[63] Continuation of Ser. No. 516,880, Oct. 21, 1974, abandoned.

[30] Foreign Application Priority Data

Oct. 26, 1973 Finland ..... 733324

[51] Int. Cl.[2] ..... F16K 31/34

[52] U.S. Cl. ..... 137/413; 137/423; 137/195

[58] Field of Search ..... 137/195, 414, 415, 397, 137/398, 399, 423

[56] References Cited

U.S. PATENT DOCUMENTS

| | | | |
|---|---|---|---|
| 1,355,746 | 10/1920 | Justus | 137/195 X |
| 3,465,784 | 9/1969 | Cofoid | 137/399 X |
| 3,654,953 | 4/1972 | Hagdorn | 137/395 |

*Primary Examiner*—Alan Cohan

[57] ABSTRACT

A valve connects a waste water producing unit to a vacuum sewer. The valve comprises a collecting chamber receiving waste water, a closing member a connection between the collecting chamber and the vacuum sewer, a pressure controlled operating device for moving the closing member, a float moved by liquid level variations in the collecting chamber, and a pilot valve. The operating device of the closing member is controlled by the latter and the latter is controlled by the float. The operating device is constantly in connection with the vacuum system of the vacuum sewer and is influenced by the pilot valve so that the vacuum in the operating device is either increased or decreased to obtain a pressure difference in the operating device which pressure difference causes the valve opening movement.

1 Claim, 3 Drawing Figures

WASTE WATER VALVE

This is a continuation, of application Ser. No. 516,880 filed Oct. 21, 1974 now abandoned.

This invention relates to a vaste water valve connected to a vacuum sewer;

Several valves suitable for connection to a vacuum sewer are known. Among these are for instance different types of float valves which have as a common feature a plug connected to the float which plug closes the entrance opening of the vacuum sewer pipe. The valve opens when the amount of waste water collected in the float chamber is sufficient to lift the float. A float valve of this type has several disadvantages. One of them is a fast wear of the valve due to high operation frequency as the amount of liquid needed to open the valve is very small. Further, when the valve closes, vibrations occur as the closing member oscillates between closed and open positions. These vibrations cause powerful pressure chocks in the sewer piping which has a harmful effect on the function of other sewage producing equipment connected to the piping.

Attempts have been made to avoid the aforementioned disadvantages by developing more complicated valve constructions, for instance, combinations of two valves as shown in the Swedish patent specifications 334,849 and 326,139. However, the construction shown in these publications is unnecessarily complicated with several throttling ducts.

The object of the present invention is to provide a valve for a vacuum sewer which eliminates the abovementioned disadvantages. The invention is characterized in that the operating device is constantly in connection with the vacuum system of the vacuum sewer, and that the operating device is influenced by a pilot valve so that the vacuum in the operating device is either increased or decreased to obtain a pressure difference which is able to open the valve. The pilot valve makes it possible to choose the amount of water needed to open the valve as desired.

The aforementioned harmful vibrations are not present in the function of a device according to the invention, because the closing member of the valve is controlled by the pressure-difference governed operating device. It has also been possible to simplify the construction compared to the known art by reducing the number of throttling and other ducts.

The operating device is preferably provided with two chambers influencing a displacable pressure member, which chambers are under vacuum when the valve is closed. The valve opening movement is then easily brought about by connecting one of the chambers to the atmosphere through the float controlled pilot valve, whereby the induced pressure difference results in a movement of the pressure member.

The pressure arrangement of the chambers of the operating device can also be accomplished so that one of the chambers is constantly connected to the atmosphere and the other to the vacuum system. Still, when the valve is closed, a certain counterpressure with respect to the first-mentioned chamber is produced in the last-mentioned chamber by means of a constant air flow. When it is desired to open the valve, the air flow is reduced, whereby the vacuum increases and a pressure difference is created which opens the valve.

As a pressure member, a membrane piston can be used, or any other member capable of sensing the pressure and of transforming it into a movement.

If the closing member in the collecting chamber is made with a density smaller than that of the waste water collected in the chamber, the parts of the waste water valve can be dimensioned so that the closing member still is not able to float upwards due to the vacuum below it. Only upon reducing the vacuum below the closing member is it able to float, thus allowing the waste water to flow into the sewer. A reduction of the suction caused by the vacuum can be accomplished to free the closing member, for instance, by leading air through a duct opening up at the underside of the closing member.

The construction and the operating reliability of the valve will be improved if the bottom of the collecting chamber is made oblique, for instance conical, and the closing member is given a spherical shape. In some embodiments, it is possible that the closing member is made conical as well, whereby its return to the flow opening in proper position can be secured, for instance, with guide means.

The invention will in the following be described more in detail, with reference to the accompanying drawings, in which.

Figure 1:
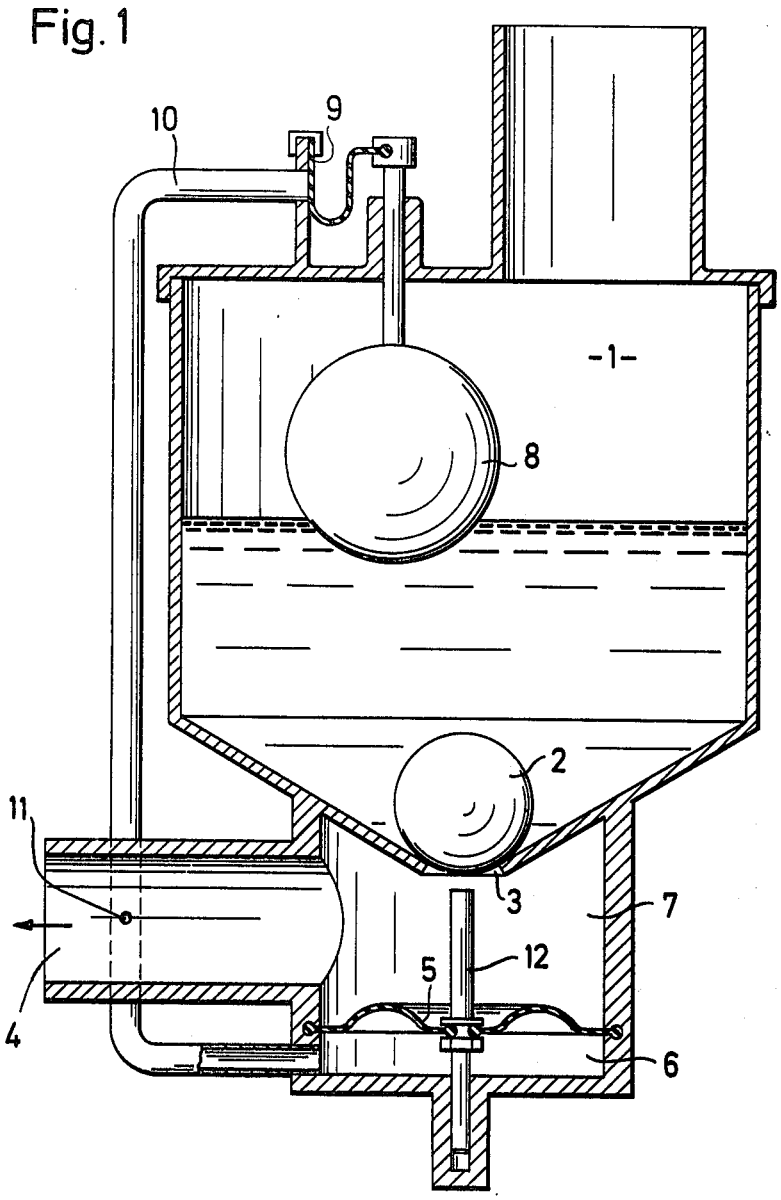
FIG. 1 is a somewhat schematic, vertical sectional view of an exemplary embodiment of the waste water valve according to the present invention.

In the drawing, 1 indicates a waste water collecting chamber and 2 a closing member that closes a connection 3 of the collecting chamber to a vacuum sewer 4. Further, 5 designates a pressure member influenced by the pressure in two chambers 6 and 7. The pressure in chamber 6 can be changed by means of a float 8, a pilot valve 9 and a duct 10.

A device of the kind corresponding to the embodiment shown in FIG. 1 functions as follows: The closing member 2 normally closes the flow opening 3 of the collecting chamber 1. When liquid is collected in the chamber 1, the float 8 rises and begins to influence the pilot valve 9 which, in turn, when the liquid level has risen high enough, allows air to flow into the duct 10. The chambers 6 and 7 are under vacuum, but through the duct 10, the chamber 6 is connected to the atmosphere, whereby the ensuing pressure difference between the chambers 6 and 7 forces the pressure member 5 upwards so that it by means of a pin member 12 lifts the closing member 2, thus opening the valve.

Correspondingly, when the liquid level sinks low enough, the pilot valve 9, governed by the float 8, closes the duct 10 and the vacuum of the vacuum sewer is again able to influence through a throttling duct 11 the chamber 6. In this way the pressure difference between the chambers 6 and 7 is equalized and the pressure member returns to its initial position allowing the valve to close. The cross-sectional area of the throttling duct 11 must of course be considerably smaller than the cross-sectional area of the duct 10.

Figure 2:
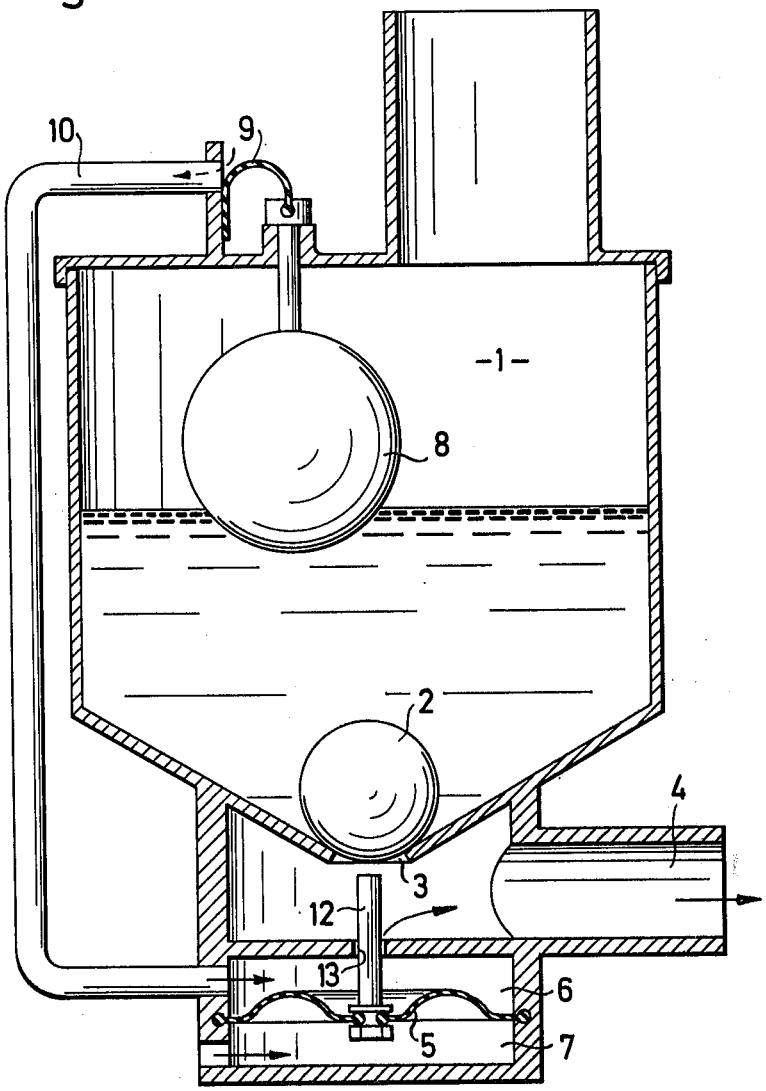
FIG. 2 is a similar view of a modified embodiment.

The device shown in FIG. 2 functions as follows: The closing member 2 normally closes the flow opening 3 of the collecting chamber 1. The chamber 7 is connected to the atmosphere and, in the chamber 6, connected to the vacuum, there is a balancing counterpressure caused by an air flow through the duct 10 and a clearance 13. As liquid is collected in the chamber 1, the float 8 rises and by means of the pilot valve 9 closes the duct 10, thus stopping the said air flow. Now, the developing pressure difference between the chambers 6 and 7 forces the pressure member 5 upwards, so that it by means of a pin member 12 lifts the closing member 2, thus opening the valve. When the liquid level in the collecting chamber sinks enough, the pilot valve opens again and the pressure in the chamber 6 rises so that the valve closes.

Figure 3:
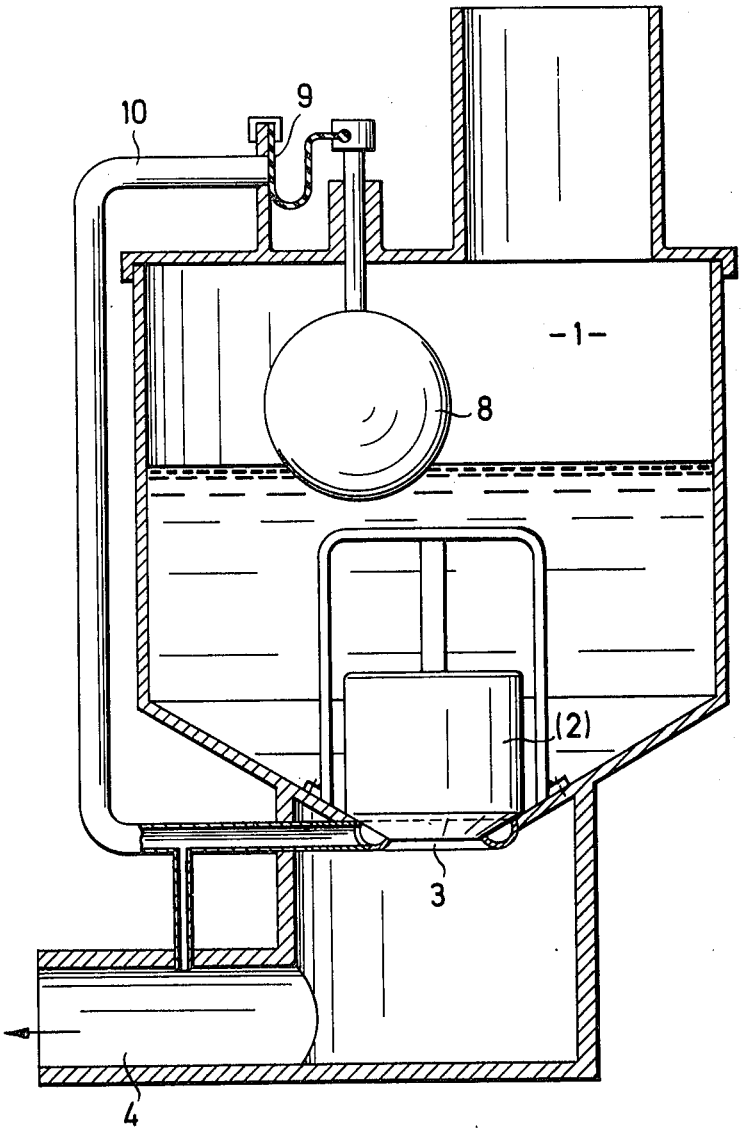
FIG. 3 is the illustration of yet another inventive embodiment.

The embodiment of FIG. 3 functions as follows: When the valve is closed, the closing member 2 closes the flow opening 3 of the collecting chamber 1. As liquid is collected in the chamber 1, the float 8 rises and starts to influence the pilot valve 9, which opens and allows air to flow into the duct 10. When the air flow is sufficient, it releases the closing member 2 from the suction of the vacuum sewer 4, and, being lighter than the waste water in the collecting chamber tank 1, the closing member 2 floats upwards, whereby the valve opens. As the liquid level sinks sufficiently, the float 8 closes the duct 10 by means of the pilot valve 9 and the suction caused by the vacuum sewer 4 acts again on the closing member 2 and the valve is closed.

The invention is not limited to the embodiments shown, but several variations are feasible within the scope of the invention.

We claim:

1. A waste water valve arrangement connectable to a vacuum sewage disposal system the function of which is based on a partial vacuum being upheld therein, said arrangement comprising a waste water collecting chamber having a waste-water inlet; a closure member normally closing an outlet passage forming a connection between said collecting chamber and said vacuum sewage disposal system; a pressure controlled operating device for displacing said closure member by means of a pressure difference available from the atmosphere and said partial vacuum of said sewage disposal system; a float displaced by liquid level variations in said collecting chamber; and a pilot valve controlled by said float, said pilot valve controlling said operating device, said operating device being constantly connected with said partial vacuum of said sewage disposal system and being free of operating elements moving in openings through partitions between spaces under different pressure, said pilot valve being arranged to control said operating device by varying the vacuum therein so as to obtain pressure changes for displacing said closure member to open said connection between said collecting chamber and said sewage disposal system; said closure member being buoyant in the liquid received by said collecting chamber, said partial vacuum of said sewage disposal system being arranged to act on the underside of said closure member, thereby preventing it from floating upwards, said pilot valve having duct means connected to a portion of said underside of the closure member, said pilot valve admitting atmospheric pressure into said duct means when said float is at a predetermined upper level in said collecting chamber for producing an increased pressure at said portion of said underside of the closure member, thereby allowing said closure member to free itself and to float upwards.

* * * * *